US007082284B2

(12) United States Patent
Nishida et al.

(10) Patent No.: US 7,082,284 B2
(45) Date of Patent: Jul. 25, 2006

(54) IMAGE FORMING APPARATUS

(75) Inventors: Satoshi Nishida, Saitama (JP); Shigetaka Kurosu, Hino (JP); Kazuteru Ishizuka, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 10 days.

(21) Appl. No.: 10/945,043

(22) Filed: Sep. 20, 2004

(65) Prior Publication Data

US 2005/0084305 A1 Apr. 21, 2005

(30) Foreign Application Priority Data

Oct. 16, 2003 (JP) ..... 2003-356066

(51) Int. Cl.
*G03G 21/00* (2006.01)

(52) U.S. Cl. ..... 399/346; 399/101; 399/343

(58) Field of Classification Search ..... 15/256.51, 15/256.52; 399/98, 99, 101, 297, 302, 308, 399/343, 347; 430/111, 126
See application file for complete search history.

(56) References Cited

U.S. PATENT DOCUMENTS 6,185,391 B1 * 2/2001 Tanioka ..... 399/101
6,233,424 B1 * 5/2001 Mohri et al. ..... 399/320
6,899,983 B1 * 5/2005 Tamoto et al. ..... 430/58.2

* cited by examiner

*Primary Examiner*—Hoang Ngo
(74) *Attorney, Agent, or Firm*—Lucas & Mercanti, LLP

(57) ABSTRACT

There is described an image forming apparatus which forms a toner image on a transfer material by transferring a toner image from a photoreceptor element to an intermediate transfer member and then transferring the toner image from the intermediate transfer member to the transfer sheet. The apparatus includes: a developing section to develop the electrostatic latent image with toner so as to form the toner image; a first transferring section to transfer the toner image formed on the photoreceptor element onto the intermediate transfer element; a second transferring section to further transfer the toner image onto a transfer material; a lubricant supplying section to supply a lubricant, which includes at least a fatty acid calcium salt, onto the photoreceptor element in such a manner that the lubricant is added to the toner; and a polishing section to polish a surface of the intermediate transfer element.

6 Claims, 2 Drawing Sheets

IMAGE FORMING APPARATUS

BACKGROUND OF THE INVENTION

This invention relates to an image forming apparatus which forms a toner image on a transfer material by transferring a toner image from a photoreceptor element, serving as a photosensitive member, to an intermediate transfer member (hereinafter, also referred to as a intermediate transfer element) and then transferring the toner image from the intermediate transfer member to the transfer sheet.

To assure transferability and cleaning abilities of toners, a conventional image forming apparatus has used a developing agent made of toners and lubricants containing Ca- or Zn-related fatty acid metal salts.

Patent Document 1: Japanese Non-Examined Patent Publication H05-188643.

Patent Document 2: Japanese Non-Examined Patent Publication S60-131547.

Further, the conventional art uses toners, which have a sharp size distribution like polymerized toner and are almost spherical without edges. As these toners are sharp in the size distribution, the charge distribution is also sharp in most cases and their developing properties are good. However, the toners will be easily packed closest, agglutinates, and hard to be transferred. Additionally, such toners are hard to be cleaned. Patent Documents 3 to 6 try to assure transferability and cleaning ability of toners by applying a lubricant to the photoreceptor element besides lubricants added to the toners.

Patent Document 3: Japanese Non-Examined Patent Publication H06-148941.

Patent Document 4: Japanese Non-Examined Patent Publication 2001-282043.

Patent Document 5: Japanese Non-Examined Patent Publication H11-212398.

Patent Document 6: Japanese Non-Examined Patent Publication H11-219087.

However, if the lubricant applied to the photoreceptor element and the lubricant added to the toners are not proper, the photoreceptor element may have a lubricant film on the surface of the photoreceptor element.

Patent Document 7: Japanese Non-Examined Patent Publication 2001-166659.

The lubricant film on the surface of the photoreceptor element is acceptable as far as it is uniform on the whole surface of the photoreceptor element. However, when the photoreceptor element is cleaned by a cleaning blade or the like, some part of the lubricant film may locally remain un-removed on the surface of the photoreceptor element. As the lubricant is high in electric resistance, the total resistance of the local films left on the surface of the photoreceptor element may be high and as the result the transfer ratio reduces. This causes local longitudinal streaks of low or high densities in the image.

Further, naturally, it is impossible to uniformly apply a lubricant to the surface of the photoreceptor element. The lubricant is locally excessive on some part of the surface of the photoreceptor element and insufficient on the other part of the surface. This makes the developing ability and the transferability uneven and finally makes the image rough. In an image forming apparatus that transfers a toner image from a photoreceptor element to an intermediate transfer member and then transfers a toner image from the intermediate transfer member to a transfer sheet, it is impossible to control the formation of a lubricant film on the intermediate transfer member. Consequently, in such an image forming apparatus, the image density may be uneven on the transfer sheet.

Further, the image densities are made uneven also by deterioration of toners in the developing devices. This often occurs when images of low-print areas are formed continuously. This is because most of toners are circulated in the developing devices vainly. As the result, the lubricant added to the toners is lost and the developing ability, transferability, and cleaning ability of the toners are deteriorated.

SUMMARY OF THE INVENTION

To overcome the abovementioned drawbacks in conventional image-forming apparatus, it is an object of the present invention to provide an image forming apparatus that forms images without any streak caused by uneven films on a photoreceptor element, serving as a photosensitive member, or an intermediate transfer element and without damaging the photoreceptor element, the intermediate transfer element, and the cleaning blade.

Accordingly, to overcome the cited shortcomings, the abovementioned object of the present invention can be attained by image-forming apparatus described as follow.

(1) An apparatus for forming an image, comprising: a photoreceptor element; a charging section to charge the photoreceptor element; an exposing section to expose an electrostatic latent image on the photoreceptor element; a developing section to develop the electrostatic latent image with toner so as to form an toner image; an intermediate transfer element; a first transferring section to transfer the toner image formed on the photoreceptor element onto the intermediate transfer element; a second transferring section to further transfer the toner image, transferred onto the intermediate transfer element by the first transferring section, onto a transfer material; a lubricant supplying section to supply a lubricant, which includes at least a fatty acid calcium salt, onto the photoreceptor element in such a manner that the lubricant is added to the toner; and a polishing section to polish a surface of the intermediate transfer element.

(2) The apparatus of item 1, wherein an amount of the lubricant added to the toner is equal to or greater than 0.03%-by-mass of an amount of the toner.

(3) The apparatus of item 1, wherein an amount of the lubricant added to the toner is equal to or greater than 0.2%-by-mass of an amount of the toner.

(4) The apparatus of item 1, further comprising: a lubricant applying section to apply the lubricant onto the photoreceptor element.

(5) The apparatus of item 1, wherein the polishing section includes a brush roller having fibers in which a titanium oxide serving as an abrasive material is mingled, and polishes the surface of the intermediate transfer element in such a manner that the brush roller is driven to rotate in a state of directly contacting the intermediate transfer element.

(6) The apparatus of item 1, wherein a plurality of photoreceptor elements, each of which is equivalent to the photoreceptor element and corresponds to each of primary colors, and a plurality of developing sections, each of which is equivalent to the developing section and corresponds to each of the primary colors, are provided for forming a color image.

(7) The apparatus of item 1, further comprising: a cleaning section to clean the surface of the intermediate transfer element.

According to the present invention, in the image forming apparatus having an intermediate transfer member, the formed images are free from streaks due to uneven films on the surface of the intermediate transfer member. Further, the image forming apparatus can form a lot of images steadily for a long time without curling and destroying the cleaning blade of the endless-belt shaped intermediate transfer member even if a serial multiple copy processing continues.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENTS

This invention will be described in further detail by way of embodiments. It is to be expressly understood, however, that the description is not intended to limit the technical ranges and terms in claims. Further, the assertive explanation in the embodiments of this invention is for the best mode of this invention and is not intended to limit the technical ranges and terms of this invention.

Figure 1:
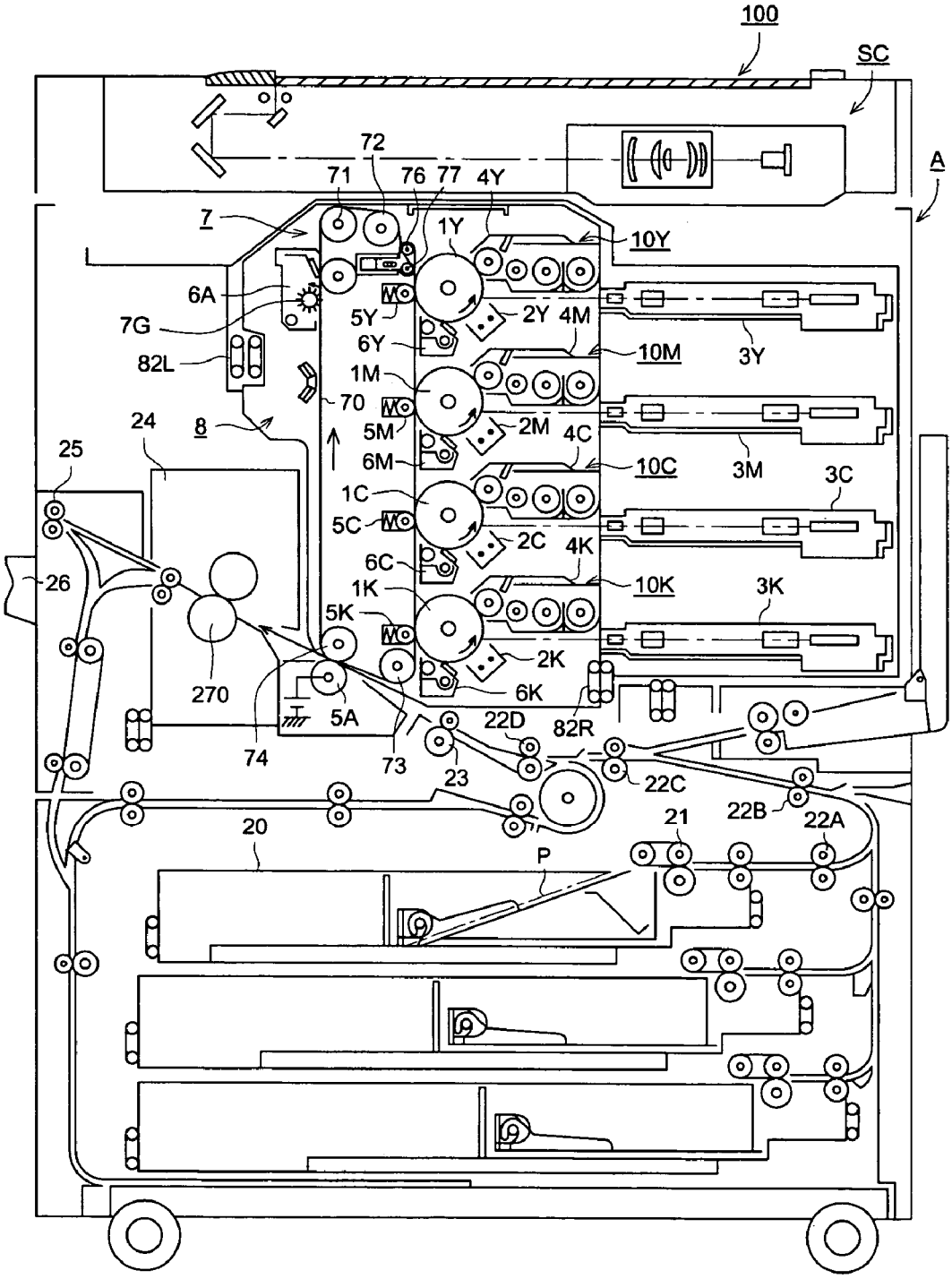
FIG. 1 shows the cross-sectional view of the configuration of a color image forming apparatus embodied in the present invention.

FIG. 1 shows the cross-sectional view of the configuration of a color image forming apparatus which is an embodiment of this invention.

This image forming apparatus 100 is generically called a tandem type full-color image forming apparatus and consists of some sets of an image forming section 10 (10Y, 10M, 10C, and 10K), an endless belt-like intermediate transfer unit 7, a paper delivery means 21, and a fixing device 24. A document image reader SC is provided on the top of the main body A of the image forming apparatus.

The image forming section 10Y for forming a yellow image consists of a drum-like photoreceptor element 1Y which is surrounded by a charger 2Y, an image exposing means 3Y, a developer 4Y, a primary transfer roller 5Y as a primary transfer means, and a cleaning means 6Y. The image forming section 10M for forming a magenta image consists of a drum-like photoreceptor element 1M which is surrounded by a charger 2M, an image exposing means 3M, a developer 4M, a primary transfer roller 5M as a primary transfer means, and a cleaning means 6M. The image forming section 10C for forming a cyan image consists of a drum-like photoreceptor element 1C which is surrounded by a charger 2C, an image exposing means 3C, a developer 4C, a primary transfer roller 5C as a primary transfer means, and a cleaning means 6C. The image forming section 10K for forming a black image consists of a drum-like photoreceptor element 1K which is surrounded by a charger 2K, an image exposing means 3K, a developer 4K, a primary transfer roller 5K as a primary transfer means, and a cleaning means 6K.

The endless belt-like intermediate transfer unit 7 as an intermediate transfer member is equipped with an endless belt-like intermediate transfer member 70 as a semi-conductive endless belt type intermediate transfer member which are supported and rotated by a plurality of rollers.

Color images formed by the image forming sections (10Y, 10M, 10C, and 10K) are respectively transferred onto the moving endless belt-like intermediate transfer member 70 in sequence by the corresponding primary transfer rollers (5Y, 5M, 5C, and 5K) to form a multi-color image. A transfer sheet P such as a paper sheet as a recording medium is picked up from a paper cassette 20 by a paper feeding means 21, carried by a plurality of intermediate rollers (22A, 22B, 22C, and 22D) and registration rollers 23, then carried to the secondary transfer rollers 5A as the secondary transfer means, and has all color images transferred onto the transfer sheet P at a time. The transfer sheet having the multi-color image on it is fixed by the fixing device 24 and ejected to the outside stack tray 26 by the ejection rollers 25.

After transferring a multi-color image onto the transfer sheet P by the secondary transfer roller 5A as the secondary transfer means and separating the transfer sheet P in a curving manner, the endless belt-like intermediate transfer member 70 is cleaned to remove the left-over toner by the cleaning means 6A.

While an image is formed, the primary transfer roller 5K is always pressed against the photoreceptor element 1K. The other photoreceptor elements (1Y, 1M, and 1C) are pressed against the corresponding transfer rollers (5Y, 5M, and 5C) only when color images are formed.

The secondary transfer roller 5A is pressed against the endless belt-like intermediate transfer member 70 only when transferring a multi-color image onto the transfer sheet P that passes through these rollers 5A.

The assembly 8 can be pulled out from the main body A of the image forming apparatus by means of supporting rails (82L and 82R).

The assembly 8 consists of the image forming sections (10Y, 10M, 10C, and 10K) and the endless belt-like intermediate transfer unit 7.

The image forming sections (10Y, 10M, 10C, and 10K) are vertically disposed in series. The endless belt-like intermediate transfer unit 7 is provided to the left of the photoreceptor elements (1Y, 1M, 1C, and 1K). The endless belt-like intermediate transfer unit 7 consists of the endless belt-like intermediate transfer member 70 that are supported and moved by rollers (71, 72, 73, 74, 76, and 77), primary transfer rollers (5Y, 5M, 5C, and 5K), and the cleaning means 6A.

When pulled out of the main body of the image forming apparatus, the assembly 8 comes out together with the image forming sections (10Y, 10M, 10C, and 10K) and the endless belt-like intermediate transfer unit 7 in a body.

The image forming apparatus forms a toner image on each photoreceptor element (1Y, 1M, 1C, and 1K) by charging, exposing, and developing, transfers each color image in sequence to form a multi-color image on the endless belt-like intermediate transfer member 70 (as a primary transfer), transfers a multi-color image onto the transfer sheet P at a time, presses and heats to fix the image on the transfer sheet P by the fixing device 24. After transferring each color toner image onto the endless belt-like intermediate transfer member 70, each photoreceptor element (1Y, 1M, 1C, and 1K) is cleaned to remove the left-over toner by the corresponding cleaning means (6Y, 6M, 6C, and 6K), and repeats the above charging, exposing, and developing steps to form the next image.

Each photoreceptor element (1Y, 1M, 1C, and 1K) is 60 mm in the diameter and its process speed is 220 mm/s. The image forming apparatus of this invention is a tandem type full-color image forming apparatus 100 using an endless belt-like intermediate transfer member 70 as an intermediate transfer member. The primary transfer roller in the apparatus 100 is a 20 mm-diameter sponge roller whose resistance is $1\times10^7$ Ω and the primary transfer is controlled by a constant current control method.

Figure 2:
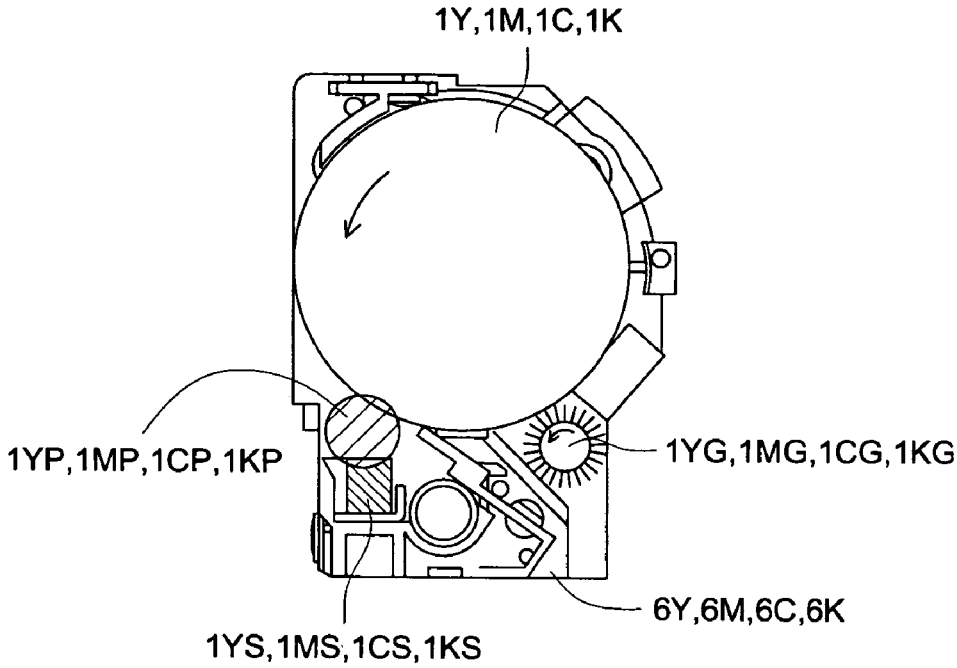
FIG. 2 shows the cross-sectional view of a means for applying lubricant to the photoreceptor element and a polishing means of the image forming apparatus embodied in the present invention.
Figure 3:
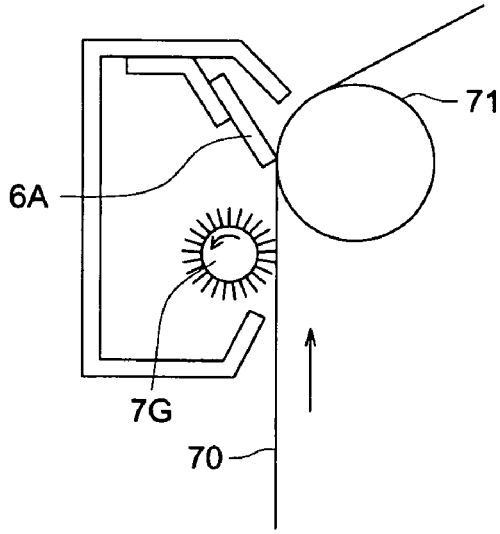
FIG. 3 shows the means for polishing the intermediate transfer member of the image forming apparatus embodied in the present invention.

As shown also in FIG. 2, lubricant applying means (1YP, 1MP, 1CP, and 1KP) are provided to apply lubricant to the photoreceptor elements (1Y, 1M, 1C, and 1K). Each lubricant applying means is a 12 mm-diameter brush roller that plants conductive acrylic fibers of 6.25 deniers on the surface of the roller at a density of 100K fibers per square inch. The brush rotates opposite to the rotation of the photoreceptor element at a line speed of 132 mm/sec. Each lubricant (1YS, MS, 1CS, and 1KS) is 8 mm wide×5 mm high×332 mm high and has the hardness equivalent to pencil hardness HB.

The lubricant contains at least fatty acid metal salt of calcium stearate. The toner as a developing agent is a polymerization toner of 6.5 μm in size. The quantity of the lubricant is added at a concentration of 0.01 to 0.3%-by-mass to the total quantity of toner (of each color).

Besides the cleaning means 6A that removes the left-over toner from the surface of the endless belt-like intermediate transfer member 70, a polishing means 7G is provided to polish the surface of the endless belt-like intermediate transfer member 70. This means 7G is a brush roller that plants nylon fiber mixed up with titanium oxide. The brush is pressed at a bite of 1.0 mm against the intermediate transfer member and driven to rotate opposite to the rotation of the intermediate transfer member.

The endless belt-like intermediate transfer member 70 is a single layer half-conductive polyimide belt of 0.1 mm thick×861 mm circumferential×362 mm wide and the surface resistivity of $10^{10}$ to $10^{11}$ Ω·cm.

We inventors tested and evaluated image formation of the image forming apparatus of this invention as follows:

Image Formation Test 1A:

We made 200,000 copies by the image forming apparatus equipped with the polishing means 7G in accordance with the above embodiment. (Test #1 to Test #10).

Image Formation Test 1B:

We made 200,000 copies by the image forming apparatus without the polishing means 7G in accordance with the above embodiment. (Test #11 to Test #20).

We checked the first copy and the 200,000$^{th}$ copy for longitudinal streaks in images, image roughness, and curling of the cleaning blade of the endless belt-like intermediate transfer unit and evaluated the images by the following:

Level 5 and 4: Excellent

Level 3 Fair but not practical

Level 2 and 1: Poor and not acceptable.

The test results are illustrated in Table 1.

In all test, the first copies are free from longitudinal streaks (Level 5).

TABLE 1

| 1B: With a polisher for the intermediate transfer belt only | | | 1A: Without a polisher | | | Evaluation value Common to both cases (1A and 1B) | |
|---|---|---|---|---|---|---|---|
| Test No. | Ca concentration | Longitudinal streaks in image | Test No. | Ca concentration | Longitudinal streaks in image | Rolled-up phenomenon of cleaning blade against intermediate transfer member | Toner scattering |
| 1 | 0.01 | 5 | 11 | 0.01 | 5 | 1 | 1 |
| 2 | 0.02 | 5 | 12 | 0.02 | 5 | 2 | 1 |
| 3 | 0.03 | 5 | 13 | 0.03 | 3.5 | 4 | 1 |
| 4 | 0.04 | 5 | 14 | 0.04 | 2 | 4 | 1 |
| 5 | 0.05 | 5 | 15 | 0.05 | 2 | 5 | 1.5 |
| 6 | 0.06 | 5 | 16 | 0.06 | 1.5 | 5 | 2.5 |
| 7 | 0.08 | 5 | 17 | 0.08 | 2 | 5 | 3 |
| 8 | 0.1 | 5 | 18 | 0.1 | 2 | 5 | 3.5 |
| 9 | 0.2 | 5 | 19 | 0.2 | 2 | 5 | 4 |
| 10 | 0.3 | 5 | 20 | 0.3 | 2 | 5 | 4.5 |

Longitudinal streak level of image: level 4 or higher (acceptable).

The starting copies are all excellent.

Without a polisher, longitudinal streaks in images can be suppressed only in a very limited range of Ca concentration. However, in the concentration range, the cleaning blade is curled up badly. Further, toner scattering cannot be ignored.

With a polisher for the intermediate transfer belt, the longitudinal streaks are eliminated strikingly (in comparison of the use of Zn-contained lubricant). This is a synergetic effect of the Ca-contained lubricant and a belt polisher.

This cannot be expected from the conventional art.

When the image forming apparatus has no polishing means 7G for the intermediate transfer member, it is very hard to eliminate longitudinal streaks in copied images unless the concentration of the lubricant (%-by-mass) is low (see Test #11 and Test #12). With the polishing means 7G, longitudinal streaks in copied images are suppressed strikingly in the wide range of concentration (%-by-mass) of the lubricant (see Test #1 to Test #10). However, when the concentration of the lubricant goes below 0.03%-by-mass, unwanted problems appear such as curl-up of the cleaning blade for the intermediate transfer member. Therefore, the concentration of the lubricant is preferably 0.03%-by-mass or more. The lubricant concentration of 0.2%-by-mass or more is more preferably to effectively suppress scattering of toner in the image forming apparatus (see Test #9 to Test #10).

Test #2A, Test #2B, and Test #2C, use different kinds of lubricants. These tests are different from Test #1A, and Test #1B in that the lubricants are not calcium stearate but contain fatty acid metal salt of zinc stearate.

The image formation tests were implemented as follows:

Image Formation Test 2A:

We made 200,000 copies by the image forming apparatus equipped with the polishing means 7G only for the intermediate transfer member in accordance with the above embodiment.

Image Formation Test 2B:

We made 200,000 copies by the image forming apparatus without the polishing mean 7G for the intermediate transfer member.

Image Formation Test 2C:

The image forming apparatus for this test is equipped with means for polishing the surfaces of photoreceptor elements (1Y, 1M, 1C, and 1K) besides means (6Y, 6M, 6C, and 6K) for cleaning the surfaces of photoreceptor elements (1YG, 1MG, 1CG, and 1KG). These polishing means (1YG, 1MG, 1CG, and 1KG) are prepared by dispersing powder of strontium titanate in the lubricant that is to be applied to the surfaces of photoreceptor elements (1Y, 1M, 1C, and 1K). In other words, we made 200,000 copies by the image forming apparatus by the image forming apparatus equipped with both the polishing means 7G for the intermediate transfer members and the polishing means (1YG, 1MG, 1CG, and 1KG) for the photoreceptors elements.

We used the same levels as those for Test #1A and Test #1B for evaluation.

The test results are illustrated in Table 2.

The effect becomes greater as the polishing means are applied to the intermediate transfer belt and the photoreceptor elements.

The effect of using the Zn-contained lubricant is not so dramatic as that of using the Ca-contained lubricant.

→This is what we expected from the conventional art.

As see from Table 2, it has been difficult to eliminate longitudinal streaks in copied images unless the concentration of the lubricant (%-by-mass) is low even when the polishing means 7G is provided for the intermediate transfer member (see Test #31, Test #32, and Test #33). However, in this lubricant concentration range, the cleaning blade for the intermediate transfer member may be curled up or damaged.

Contrarily it is found that, when the image forming apparatus is equipped both the belt polishing means 7G and the polishing means for the photoreceptor elements, streaks in images are strikingly improved in the wide concentration range of lubricant.

Judging from the test results of Table 1 and Table 2, when the lubricant contains fatty acid metal salt of calcium stearate containing Ca although the lubricant for the developing agents contains fatty acid metal salt of zinc stearate containing Zn, the polishing means for the intermediate transfer members only can strikingly eliminate longitudinal streaks in images in a very wide range of the lubricant concentration (%-by-mass). This enables the image forming apparatus to go without polishing of the photoreceptor elements, reducing the production cost of the apparatus and increasing the service lives of the photoreceptor elements.

Disclosed embodiment can be varied by a skilled person without departing from the spirit and scope of the invention.

What is claimed is:

1. An apparatus for forming an image, comprising:

a photoreceptor element;

a charging section to charge said photoreceptor element;

TABLE 2

| 2A: With a polisher against intermediate transfer belt only | | | 2B: Without a polisher | | | 2C: With polishers for the intermediate transfer belt and the photoreceptor elements | | | Evaluation common to cases 2A, 2B, and 2C | |
|---|---|---|---|---|---|---|---|---|---|---|
| Test No. | Zn concentration | Longitudinal streaks in image | Test No. | Zn concentration | Longitudinal streaks in image | Test No. | Zn concentration | Longitudinal streaks in image | Rolled-up phenomenon of cleaning blade for the intermediate transfer member | Toner scattering |
| 31 | 0.01 | 5 | 41 | 0.01 | 5 | 21 | 0.01 | 4.5 | 1 | 1 |
| 32 | 0.02 | 5 | 42 | 0.02 | 5 | 22 | 0.02 | 5 | 2 | 1 |
| 33 | 0.03 | 4 | 43 | 0.03 | 3 | 23 | 0.03 | 5 | 4 | 1 |
| 34 | 0.04 | 3 | 44 | 0.04 | 1 | 24 | 0.04 | 5 | 4 | 1 |
| 35 | 0.05 | 3 | 45 | 0.05 | 1 | 25 | 0.05 | 5 | 5 | 1.5 |
| 36 | 0.06 | 3 | 46 | 0.06 | 1 | 26 | 0.06 | 4.5 | 5 | 2.5 |
| 37 | 0.08 | 3.5 | 47 | 0.08 | 1 | 27 | 0.08 | 5 | 5 | 3 |
| 38 | 0.1 | 3 | 48 | 0.1 | 1 | 28 | 0.1 | 5 | 5 | 3.5 |
| 39 | 0.2 | 3 | 49 | 0.2 | 1 | 29 | 0.2 | 5 | 5 | 4 |
| 40 | 0.3 | 3 | 50 | 0.3 | 1 | 30 | 0.3 | 5 | 5 | 4.5 |

an exposing section to expose an electrostatic latent image on said photoreceptor element;

a developing section to develop said electrostatic latent image with toner so as to form an toner image;

an intermediate transfer element;

a first transferring section to transfer said toner image formed on said photoreceptor element onto said intermediate transfer element;

a second transferring section to further transfer said toner image, transferred onto said intermediate transfer element by said first transferring section, onto a transfer material;

a lubricant supplying section to supply a lubricant, which includes at least a fatty acid calcium salt, onto said photoreceptor element in such a manner that said lubricant is added to said toner; and a polishing section to polish a surface of said intermediate transfer element, wherein said polishing section includes a brush roller having fibers in which a titanium oxide serving as an abrasive material is mingled, and polishes said surface of said intermediate transfer element in such a manner that said brush roller is driven to rotate in a state of directly contacting said intermediate transfer element.

2. The apparatus of claim 1, wherein an amount of said lubricant added to said toner is equal to or greater than 0.03%-by-mass of an amount of said toner.

3. The apparatus of claim 1, wherein an amount of said lubricant added to said toner is equal to or greater than 0.2%-by-mass of an amount of said toner.

4. The apparatus of claim 1, further comprising:

a lubricant applying section to apply said lubricant onto said photoreceptor element.

5. The apparatus of claim 1, wherein a plurality photoreceptor elements, each of which is equivalent to said photoreceptor element and corresponds to each of primary colors, and a plurality of developing sections, each of which is equivalent to said developing section and corresponds to each of said primary colors, are provided for forming a color image.

6. The apparatus of claim 1, further comprising:

a cleaning section to clean said surface of said intermediate transfer element.

* * * * *